US005779851A

United States Patent [19]

Ifkovits et al.

[11] Patent Number: 5,779,851

[45] Date of Patent: Jul. 14, 1998

[54] WEB SPLICING APPARATUS

[75] Inventors: Michael R. Ifkovits, Danbury; Anthony M. Macelis, Watertown; Thomas E. Tyrrell, Brookfield, all of Conn.

[73] Assignee: Pitney Bowes Inc., Stamford, Conn.

[21] Appl. No.: 728,587

[22] Filed: Oct. 10, 1996

[51] Int. Cl.[6] ..... A65H 21/00

[52] U.S. Cl. ..... 156/505; 156/253; 156/304.3; 156/506; 156/523; 30/358; 30/365; 83/614; 83/665; 83/676

[58] Field of Search ..... 156/157, 253, 156/304.3, 505, 506, 509, 523; 30/358, 365; 83/614, 665, 676

[56] References Cited

U.S. PATENT DOCUMENTS

| | | | |
|---|---|---|---|
| 3,354,769 | 11/1967 | Abramson et al. | 83/614 |
| 3,532,018 | 10/1970 | Szabo | 83/614 |
| 3,773,598 | 11/1973 | Taeffner et al. | 156/505 |
| 3,776,795 | 12/1973 | Stevenson | 156/505 X |
| 4,239,582 | 12/1980 | McGrath | 156/505 |
| 4,315,450 | 2/1982 | Pray | 83/614 X |
| 4,679,476 | 7/1987 | Abreu | 83/614 X |
| 5,242,527 | 9/1993 | Meschi | 156/505 |
| 5,460,682 | 10/1995 | Beasley et al. | 156/344 |

FOREIGN PATENT DOCUMENTS

| | | | |
|---|---|---|---|
| 750893 | 1/1967 | Canada | 156/505 |

*Primary Examiner*—Mark A. Osele
*Attorney, Agent, or Firm*—Christopher Capelli; Melvin J. Scolnick; Robert Meyer

[57] ABSTRACT

Disclosed is an apparatus for aligning the leading and trailing edges in abutting relationship of two adjacent webs preparatory to splicing the abutting edges together with adhesive tape, and for perforating the tape subsequent to being applied to the adjacent web wedges along the seam formed by the web edges. The apparatus comprises a fixture adapted to lie on a flat surface for holding the trailing and leading edge portions of a pair of preceding and succeeding tapes securely in place with the end edges thereof abutting so that a piece of adhesive tape can be applied thereto. The apparatus also comprises a device which cooperates with a guide on the fixture for perforating the tape along the seam formed by the aforementioned edges so that the web sheets can be separated by feeding the web into a bursting machine or otherwise.

11 Claims, 5 Drawing Sheets

WEB SPLICING APPARATUS

BACKGROUND OF THE INVENTION

The present invention relates generally to the field of devices and apparatus for splicing ends of webs together, and more particularly to a web splicing fixture and a tape perforating device for use therewith.

The advent of high speed computer printing technology during the past decade or more has led to the development of an abundance of technologically complex related peripheral equipment for handling the output of most computer printers. Typically, high speed computer printers print data in a variety of forms, including conventional text, on a continuous web of individual sheets which may be blank or pre-printed with certain data and separated by a perforation line so that the sheets can be separated from one another by manual tearing or by feeding the web through a variety of commercially available bursting machines which separate the sheets by a snapping action. The high rate of speed at which the sheets can be printed, together with the development of a variety of collating and/or sorting and envelope inserting machines, have resulted in various types of automated high speed sheet handling processes involving several or all of the following steps: imprinting the individual sheets while still in web form, separating the sheets by bursting or otherwise, adding other forms of documents from a collating machine or the like, feeding the imprinted sheets and other documents to an accumulator to form a uniform collation, feeding the collation to a folding machine, feeding the folded collation to an envelope inserting machine where the it is inserted into an envelope, feeding the envelope with the collation therein through a postage metering machine which prints a postage indicia on the envelope, and finally feeding the envelope to a suitable stacking machine for further handling, such as depositing with the U. S. Postal Service. It should be understood, of course, that the foregoing is only a representative sequence of operations which may be carried out in a particular installation, and one or more of the foregoing steps may be omitted, or other more specialized steps may be added, depending on the requirements of the particular sheet processing installation.

The apparatus and machines required for carrying out such complex sheet processing operations as just described are typically very expensive to purchase, operate and maintain, and can be justified on a cost effectiveness basis only if they operate at relatively high rates of speed, and for extended periods of time without interruption. Typically, a stack of fan fold sheets is about 12 to 15 inches high and weighs about 20 pounds, and consists of approximately 5000 individual sheets joined together in web form and separated by a perforation line so that the sheets can be folded into a fan fold configuration. In typical operating environments, the fan fold webs are processed at speeds ranging from 5000 to 14000 sheets per hour, depending on the complexity of the sheet processing machine involved, with the result that a fan fold stack having 5000 sheets will pass through the sheet processing machine or apparatus in approximately 30 minutes. Since the machines and apparatus under consideration are typically large and expensive, they are cost effective only if they remain in operation substantially throughout a work day. Based on the foregoing figures, approximately 50 stacks of fan fold web can be fed through the processing machine in the course of a day. Thus, to accomplish this rate and duration of operation, it is necessary to maintain a constant supply of fan folded web material at the input end of whatever is the sequence of machines required to carry out the sheet handling process at a particular installation.

As a practical matter, the web material on which computer printers imprint data is manufactured and pre-printed (if in fact pre-printing is done) in the form of a web having a finite length, which is then perforated at even intervals to form discrete sheets, and the web is then fan folded at the perforations to form a stack of fan folded material and packaged in a carton. The length of the web, and hence the size of the stack, is selected such that it can be conveniently handled by an operator of the computer imprinting apparatus, with each stack weighing in the order of 20 pounds. If the original web is too long, thereby making the stack too heavy for a typical operator of the apparatus involved, the task of keeping the machines running at an optimum rate becomes too great.

Thus, it becomes necessary for operators of the apparatus to constantly splice the trailing edge of a preceding stack to the leading edge of a succeeding stack so that what is presented to the sheet handling apparatus is a continuous web of fan folded material having an indefinite length, i.e., whatever length is necessary to process all of the sheets that are involved in a particular application. For example, if the application is to print the monthly accounts of hundreds of thousands of charge card customers, it is apparent that the web for any given print run may be many more hundreds of thousands of sheets long, assuming multiple sheets per account.

Prior to the present invention, web splicing was carried out either by prior art machines or by a manual procedure which involved the use of commercially available perforated adhesive backed tape. Although known tape splicing machines perform the intended function with considerable accuracy and speed, they are relatively complex and expensive, and represent yet another machine in an already lengthy string of complex machines in which trouble can develop and slow down or interrupt the sheet processing operation.

The manual procedure eliminated the need for any complex and expensive splicing machine, but was unacceptable for another reason In this procedure, the trailing edge portion of a preceding stack of fan folded material and the leading edge portion of a succeeding stack were placed on a flat surface with the edges of each portion in abutting relationship, and a strip of perforated tape was placed across the abutting edges. While this system worked well when performed accurately, it required that the operator place the tape on the abutting edges with great accuracy such that the perforation line on the tape was precisely aligned with the abutting edges. If the perforation line on the tape overlapped one or the other edge portions, and the joined web was fed through a bursting machine, the resulting sheets would be severed unevenly, thereby resulting in unacceptable sheets in the collation and possibly a paper jam in a downstream apparatus that could shut down the entire operation. It is apparent, of course, that the accurate placement of the perforated tape with the perforation line disposed precisely over the abutting edges required considerable time and effort which often caused delay and interruption in the otherwise smooth flow of fan folded material through the subsequent processing.

Thus, there is a need for a simple, inexpensive and easy to operate tape splicing apparatus that permits the trailing and leading ends of preceding and succeeding stacks of fan folded web material to be spliced with complete accuracy and in a minimum of time in order to ensure a continuity of web material to the sheet processing apparatus at a rate at which it is needed to maintain uninterrupted operation of the sheet handling process.

BRIEF SUMMARY OF THE INVENTION

The present invention greatly obviates if not substantially eliminates the disadvantages of the prior art methods of splicing webs together either through the use of machines or by the manual procedure. The present invention relies on a combination of a manual operation utilizing adhesive backed tape which is manually applied, and a fixture for holding the abutting edges of the trailing and leading edge portions of the preceding and succeeding web stacks in position to be taped, and a device which cooperates with the aforementioned fixture to perforate the tape along the abutting edges so that the adjacent edge portions can be easily and accurately separated in a bursting machine or otherwise. Thus, the present invention avoids the necessity for any complex and expensive machines, and also avoids the necessity for using perforated tape and the disadvantages attendant thereto.

In its broader aspects, the present invention is an apparatus for aligning the leading and trailing edges in abutting relationship of two adjacent webs preparatory to splicing the abutting edges together with adhesive tape, and for perforating the tape subsequent to being applied to the adjacent web edges along the seam formed by the web edges. In this environment, the apparatus comprises a web sheet supporting device flat body member on which the trailing edge portion of a preceding web and the leading edge portion of a succeeding web are placed. The body member includes means for positioning the trailing and leading edge portions so that the edges thereof are disposed in abutting relationship, so that a strip of adhesive tape can be placed on the trailing and leading edge portions over the abutting edges to secure them together. An elongate guide means is adapted to be positioned on the body member in overlying relationship with the edges of the trailing and leading edge portions and the tape to secure them to the body member. Finally, a perforating device is adapted to be moved along the guide means from one end thereof to the other for perforating the tape along the abutting edges of the trailing and leading edge portions to form a partially perforated weakened line across the tape, so that the trailing and leading edge portions of the preceding and subsequent webs can be subsequently separated by severing the remaining portions of the tape along the perforated line.

In some of its more limited aspects, the guide means includes a plurality of elongate sheet pressing members which overlie the trailing and leading edge portions to hold them to the body member and to provide properly spaced guide edges for guiding the perforating device along the abutting edges of the trailing and leading edge portions of the respective webs. The perforating device includes a handle having two relatively movable parts, with a protective abutment on the end of one part which normally extends beyond the outer periphery of a perforating blade mounted on the corresponding end of the other part so as to normally protect the blade. The part mounting the blade is movable so as to extend the blade beyond the protective abutment when the perforating device is moved over the tape along the guide means.

Having briefly described the general nature of the present invention, it is a principal object thereof to provide a web splicing apparatus for easily and accurately splicing the abutting edges of the trailing and leading edge portions of preceding and succeeding stacks of fan folded web material.

It is another object of the present invention to provide a web splicing apparatus which combines a relatively simple manual operation of applying a strip of tape to the abutting edges with a relatively simple aligning fixture and perforating device so as to splice the web in a highly accurate manner and very rapidly.

It is still another object of the present invention to provide a web splicing apparatus which is very inexpensive to manufacture, easy to use and requires virtually no maintenance.

These and other objects and advantages of the invention will become more apparent from an understanding of the following detailed description of a presently preferred embodiment of the invention when considered in conjunction with the accompanying drawings.

DETAILED DESCRIPTION OF THE INVENTION

Figure 1:
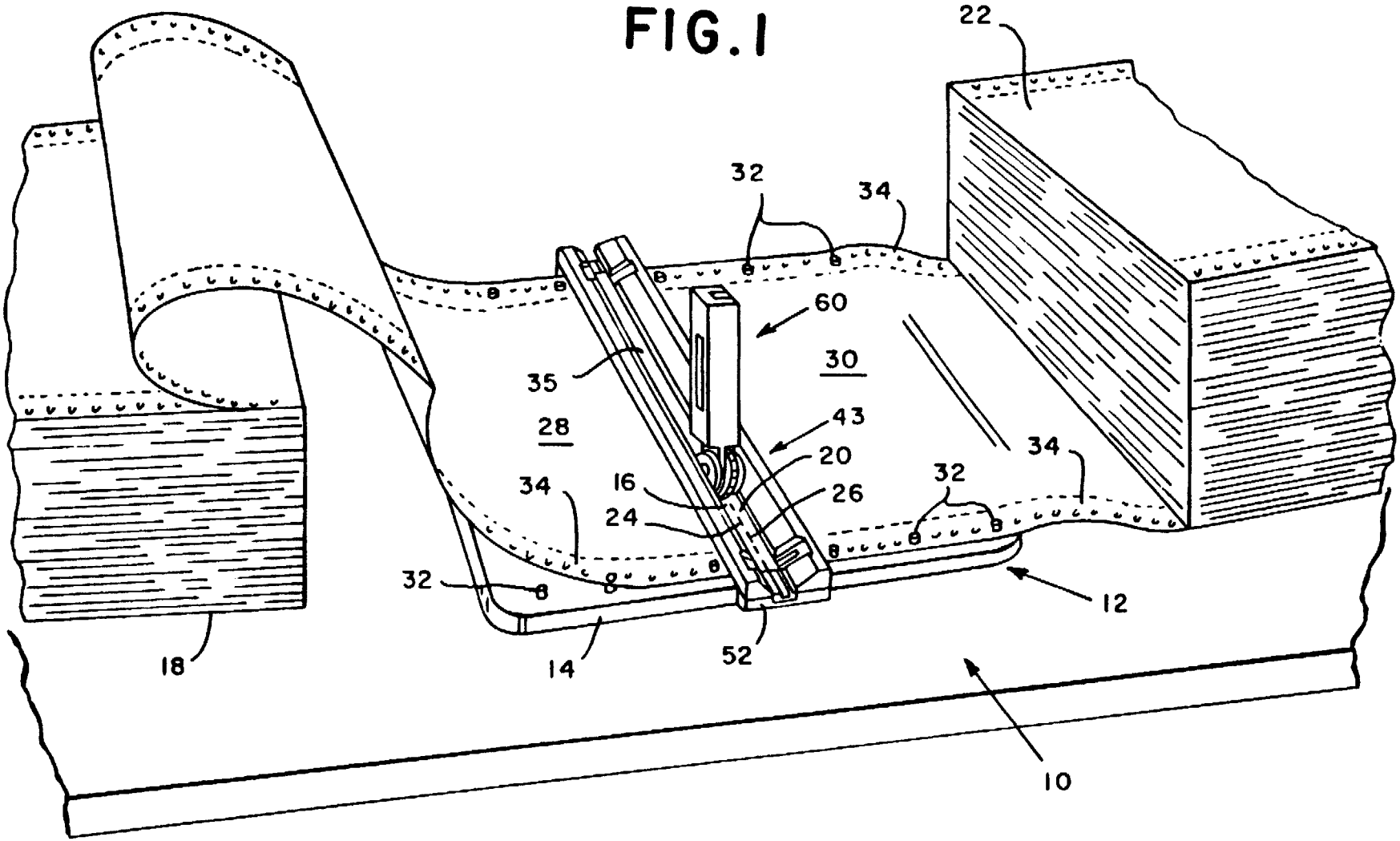
FIG. 1 is a perspective view of a pair of stacks of fan folded web material resting on a supporting surface with the trailing edge portion of the preceding stack and the leading edge portion of the succeeding stack resting on the sheet supporting surface in position to have the abutting edges of the trailing and leading edge portions spliced together, showing the guide means in position on the web edge portions, and the perforating device in position on the guide means.

Referring now to the drawings and more particularly to FIGS. 1 to 4 thereof, the web aligning and tape perforating apparatus of the present invention is indicated generally by the reference numeral 10, and comprises a generally rectangular sheet supporting device, indicated generally by the reference numeral 12, which preferably is a flat body member 14 on which the trailing edge portion 16 of a preceding stack 18 of fan folded web material, and the leading edge portion 20 of a succeeding stack 22 of fan folded web material are placed in such a manner that the adjacent edges 24 and 26 of the edge portions 16 and 20 respectively are disposed in abutting relationship. Preferably, the body member 14 is dimensioned so that it can accommodate a major portion of two web sheets, the last sheet 28 of the preceding stack 18 and the first sheet 30 of the succeeding stack 22. The body member 14 is provided with a plurality of pins 32 positioned along opposite lateral sides of the body member 14 over which the feed pin apertures of the typical aperture strip 34 of fan folded computer printer paper are placed in order to properly position the web sheets 28 and 30 with the edges 24 and 26 thereof in abutting relationship so that a strip of adhesive tape 35 can be placed across the trailing and leading edge portions 16 and 20 over the abutting edges 24 and 26 to secure them together.

Figure 3:
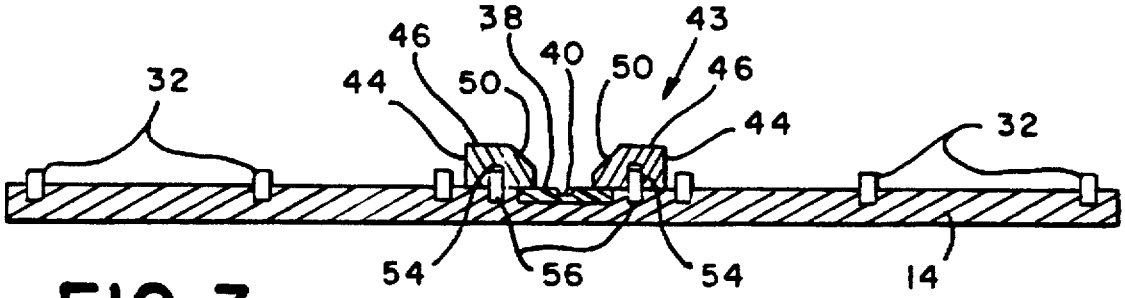
FIG. 3 is a sectional view of the sheet supporting device taken on the line 3—3 of FIG. 2.
Figure 4:
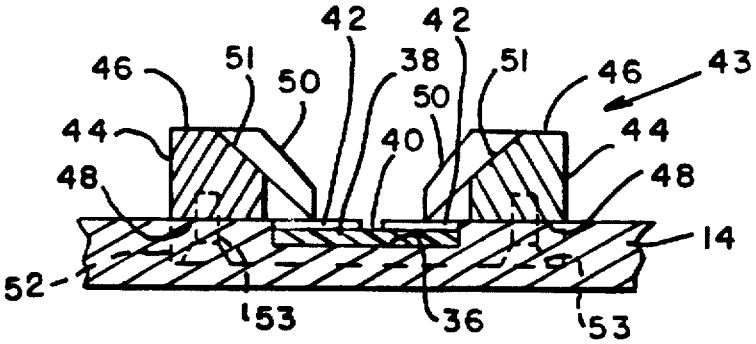
FIG. 4 is a fragmentary sectional view of the sheet supporting device taken on the line 4—4 of FIG. 2.

As best seen in FIGS. 3 and 4, the body member is provided with a central recess 36 which receives an insert 38 preferably formed of a suitable synthetic material such as nylon and which extends laterally across the body member 14 from one lateral side to the other. The insert 38 has a longitudinal shallow groove 40 extended the length of the insert 38, and a pair of lateral shallow grooves 42 closely spaced to the ends of the insert 38 and which intersect with the longitudinal groove 40. The grooves 42 are disposed adjacent the longitudinal edges of the body member in alignment with longitudinally extending perforation lines separating the aperture strips 34 from the sheets of the web. The sheet pressing members 44 include recesses 51 aligned with the perforating grooves 42 which are adapted to receive the perforating blade therein of a perforating device (further described below) to perforate the tape along the longitudinally extending perforation lines to maintain the continuity thereof across the trailing and leading edge portions 16 and 20 after the tape 35 has been applied to the abutting edges 24 and 26.

An elongate guide device, indicated generally by the reference numeral 43 (FIG. 1), is positioned on the body member 14 in overlying relationship with the edges 24 and 26 of the trailing and leading edge portions 16 and 20 and the strip of tape 35 to secure the trailing and leading edge portions 16 and 20 to the body member 14 during the tape perforating procedure described below. As best seen in FIGS. 2 and 3, the guide device 43 comprises a pair of web sheet pressing members 44, each of which has a top surface 46, a bottom surface 48 which rests on the upper surface of the web sheet portions 16 and 20, and inwardly slated inner side surfaces 50. The sheet pressing members 44 extend slightly beyond the lateral side edges of the body member 14, and pair of laterally extending connecting bars 52 are suitably secured, as by screws 53 to the bottom surfaces 48 of each pressing member so as to secure them together, the connecting bars 52 being spaced apart a distance substantially equal to the lateral dimension of the body member 14 so that the guide device 43 cannot shift laterally of the body member 14 once it is placed thereon. The sheet pressing members 44 are provided with a pair of recesses 54 adjacent opposite ends thereof which receive upstanding pins 56 mounted in the upper surface of the body member 14, which prevent any longitudinal movement of the guide device 43 and positions it accurately over the edge portions 16 and 20 with the longitudinal groove 40 of the insert 38 disposed centrally between the lower edges of the inwardly slanting surfaces 50 for a purpose to be made clear hereinafter.

Figure 2:
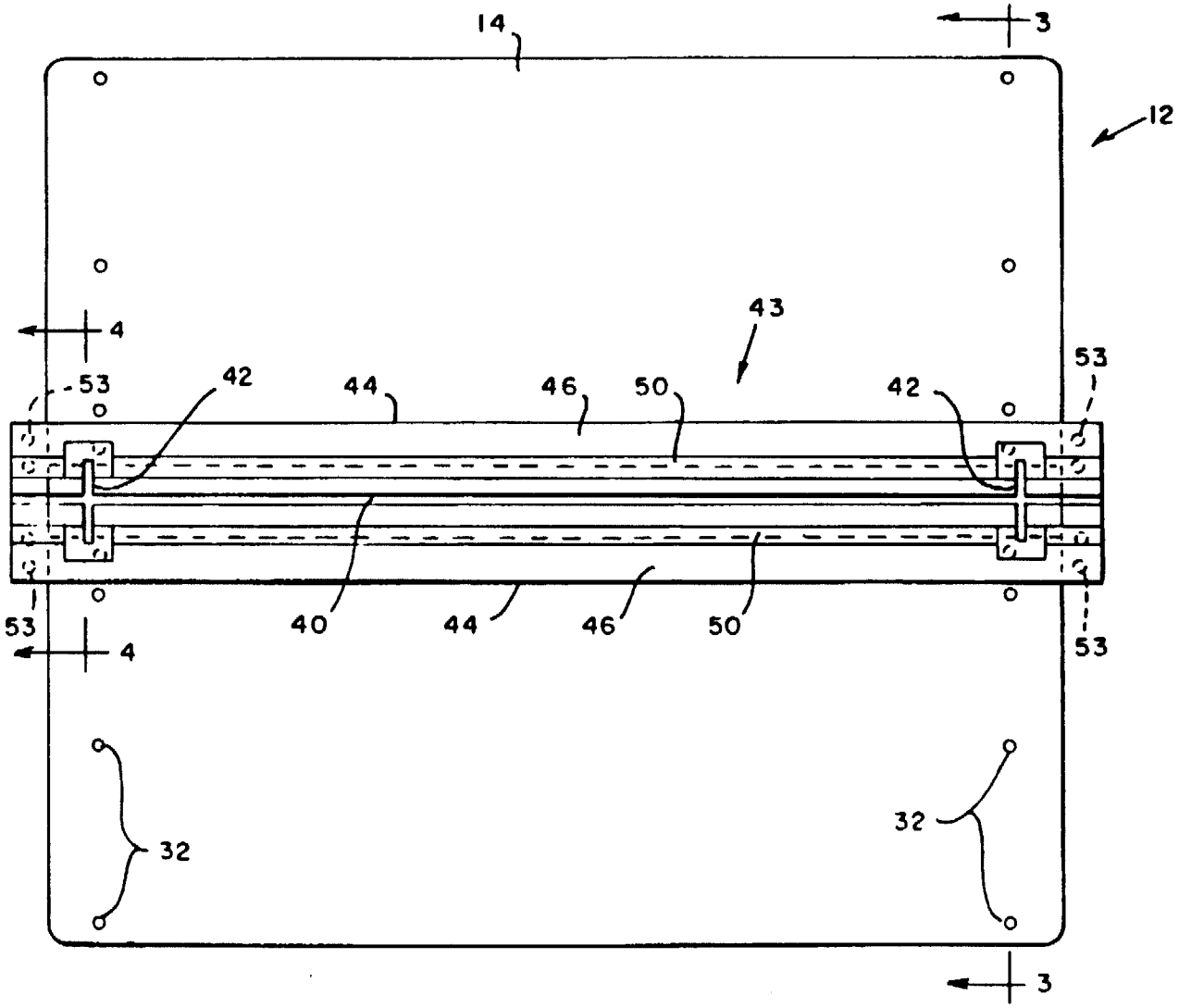
FIG. 2 is a plan view of the sheet supporting device shown in FIG. 1.
Figure 5:
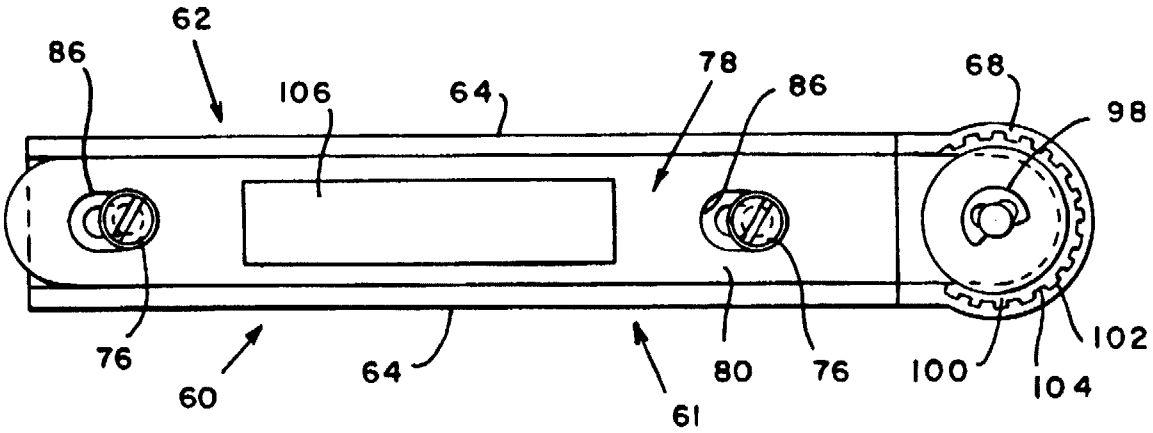
FIG. 5 is a plan view of the perforating device used with the sheet supporting device to perforate the tape placed across the abutting edges of the trailing and leading edge portions, with the parts shown in their normal non-use positions.
Figure 6:
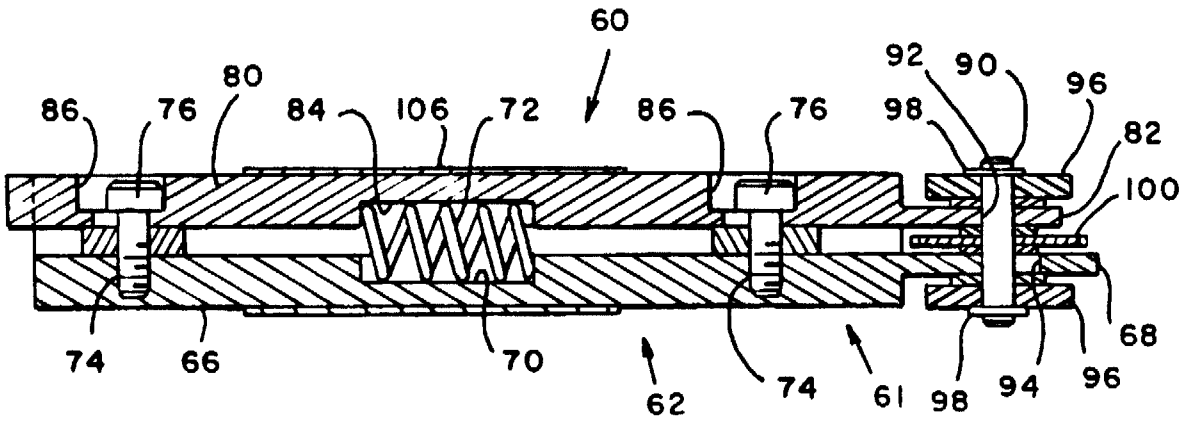
FIG. 6 is a sectional view of the perforating device shown in FIG. 5 taken on the line 6—6 of FIG. 5.
Figure 7:
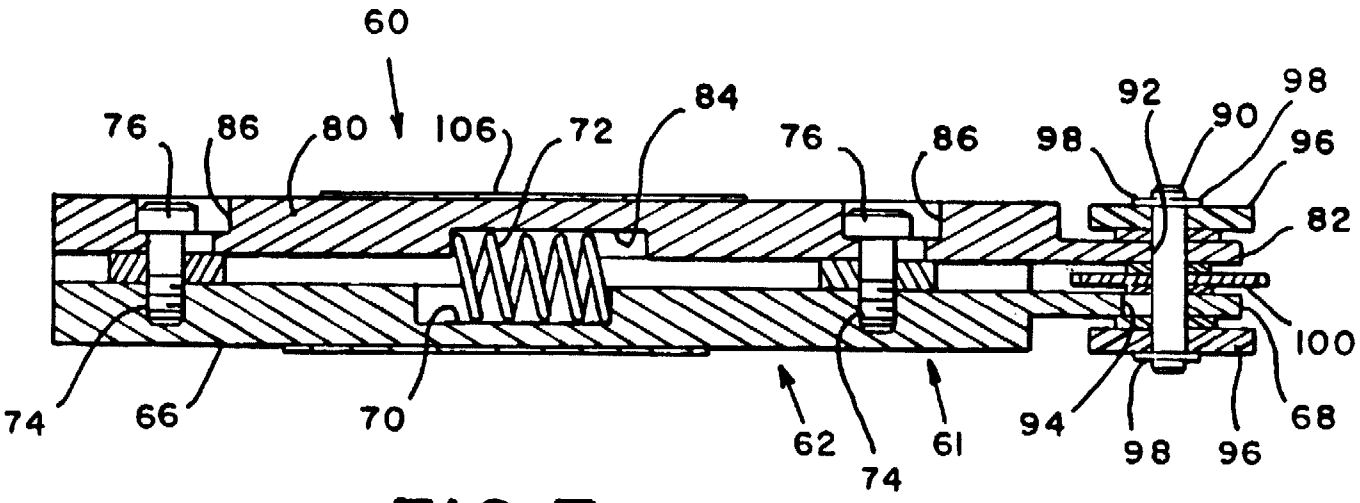
FIG. 7 is a sectional view similar to FIG. 6 but showing the parts of the device in their extended use position.

With reference now to FIGS. 5 through 7, there is seen a tape perforating device, indicated generally by the reference numeral 60, which is adapted to be moved along the guide device 43 from one end thereof to the other, as seen in FIG. 1, for perforating the tape 35 along the abutting edges 24 and 26 of the trailing and leading edge portions 16 and 20 to form a partially perforated weakened line across the tape. The perforating device comprises an elongate grasping handle, indicated generally by the reference numeral 61, which includes an elongate channel shaped housing, indicated generally by the reference numeral 62, having opposite side walls 64 and a bottom wall 66 (FIG. 6) which extends between the side walls 64 for a major portion of the length of the housing 62. The housing 62 includes a flat end portion 68 which projects beyond the channel portion defined by the side walls 64, the end portion 68 having a circular peripheral configuration as seen in FIG. 5, which constitutes a protective abutment portion to protect the peripheral cutting edge of a rotary perforating blade further described below. The housing 62 also includes an elongate recess 70 extending part way through the thickness of the bottom wall 66 which receives a compression spring 72 for maintaining the parts in the position shown in FIGS. 5 and 6 as further described below. A pair of threaded apertures 74 are also formed in the bottom wall 66 for receiving screws 76 for a purpose described below.

The tape perforating device 60 further includes a flat cover member, indicated generally by the reference numeral 78, which has a first portion 80 overlying the bottom wall 66 along the length thereof that is contiguous with the length of the side walls 64 of the channel portion of the housing 62. The cover member 78 also has a flat end portion 82 which projects beyond the channel portion of the housing 62 and which is slightly offset to the left relative to the flat end portion 68 of the housing 62 when the parts are in the positions shown in FIGS. 5 and 6. The cover member 80 also includes an elongate recess 84 extending part way through the thickness of the cover member 80 and which is complementary with recess 70 formed in the bottom wall 66 of the housing 62 so that when the cover member 78 is assembled on the housing 62, the recesses 70 and 84 form an internal bore in which the spring 72 is captured. The cover member 78 is further provided with a pair of elongate slots 86 which receive the heads of the screws 76.

As best seen in FIG. 6, a shaft 90 passes through an aperture 92 formed in the projecting portion 82 of the cover member 78, and also through an elongate slot 94 formed in the projecting portion 68 of the housing 62. A pair of wheels 96 are rotatably mounted on the shaft 90 adjacent the outward face of the projecting portions 82 and 68 of the cover member 78 and the housing 62 respectively, and held thereon in any suitable manner such as by E-clips 98. A perforating blade 100 is also mounted on the shaft 90 between the projecting portions 82 and 68, the perforating blade 100 having alternately spaced cutting blades 102 and non-cutting recesses 104.

The operation of the entire web sheet supporting device 10 and the perforating device 60 will now be described with reference to all of the figures. When it is desired to splice the abutting edges 24 and 26 of the edge portions 16 and 20 respectively, and with the guide member 43 removed from the body member 12, the edge portions 16 and 20 are placed on the body member 12 with the pins 32 projecting through the appropriate feed pin holes on the aperture strips 34 connected to opposite lateral sides of the computer printout web so that the adjacent edges 24 and 26 abut one another directly over the cutting groove 40 formed in the plastic insert 38. A strip of suitable adhesive backed tape 35, such as the well known SCOTCH® tape, is placed over the edge portions 16 and 20 to secure the abutting edges 24 and 26 together from one side of the sheets 28 and 30 to the other. It should be noted that it is not necessary that the strip of tape 35 be precisely aligned with the abutting edge 24 and 26.

The guide member 43 is then placed over the edge portions 16 and 20 with the positioning pins 56 in the recesses 54 so that the guide member 43 is properly placed on the edge portions 16 and 20 of the preceding and succeeding web stacks 18 and 20 respectively. The user then grasps the perforating device 60 and holds the housing portion 62 in the palm of his hand with his thumb resting on a friction pad 106 suitably secured to the outer surface of the flat cover member 78. By pushing on the cover member 78 while securely holding the housing 64, the cover member 78 with the curved end portion 82 thereof is moved toward the right as viewed in FIG. 6 against the bias of the compression spring 72, thereby moving the shaft 90 toward the right into the open portion of the slot 94, and the screws 76 to the right ends of the slots 86, as seen in FIG. 7. This also moves the perforating blade 100 toward the right so as to expose the cutting portions 102 beyond the periphery of the curved end portion 68 of the housing 62, as seen in FIG. 7.

With the perforating device held in this condition, it is placed on top of the splicing tape 35 at one end thereof with the wheels 96 resting on the surface of the tape, and it is drawn across the tape from one end to the other with sufficient pressure to cause the cutting portions 102 of the perforating blade 100 to perforate the tape directly over the cutting groove 40. After the tape has been perforated along the length of the groove 40, the perforating device 60 is lifted, turned 90° and placed back on the tape in the area of the short lateral grooves 42 so as to sever the tape across the width thereof to maintain continuity of the perforations defining the aperture strips 34 of the web sheets. The perforating device 60 is then removed from the perforating groove 42 and is inserted into one of the recesses 51 and rocked back and forth to perforate the perforation line between the sheets 28 and 30 and the aperture strips 34 so as to maintain the continuity of the perforation line across the trailing and leading edge portions 16 and 20 covered by the tape 35. This operation is repeated on the other side.

At this point, the splicing and perforating operations for the stacks 18 and 22 have been completed, and these stacks are ready to be moved to a staging area for delivery of the fan folded web material to the next operational machine or apparatus in the web or sheet handling process, which typically would be a bursting machine, and a new stack would be moved into the position formerly occupied by the stack 22 to have its leading edge spliced to the trailing edge of the stack 22.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. Apparatus for aligning the leading and trailing edges of two adjacent webs preparatory to splicing the edges together with adhesive tape, and for perforating the tape subsequent to being applied to adjacent abutting web edges along the seam formed by the web edges, said apparatus comprising:

a. a sheet supporting device comprising a flat body member on which the trailing edge portion of a preceding web and the leading edge portion of a succeeding web are placed, b. means on said body member for positioning said trailing and leading edge portions so that the adjacent edges of said trailing and leading edge portions are disposed in abutting relationship, so that a strip of adhesive backed tape can be placed on said trailing and leading edge portions over said abutting edges to secure said edges together, c. elongate guide means adapted to be positioned on said body member in overlying relationship with said edges of said trailing and leading edge portions and said tape to secure said trailing and leading edge portions to said body member, and d. tape perforating means adapted to be moved along said guide means from one end thereof to the other for perforating said tape along said abutting edges of said trailing and leading edge portions to form a partially perforated weakened line across the tape, whereby said trailing and leading edge portions of said preceding and subsequent webs can be subsequently separated by severing the remaining portions of the tape along the perforated line.

2. An apparatus as set forth in claim 1 wherein said positioning means on said body member comprises means disposed along opposite longitudinal edges of said body member for engaging with marginal feed holes provided along the opposite longitudinal edges of the individual sheets of said webs.

3. An apparatus as set forth in claim 1 wherein said body member includes means defining a perforating groove extending laterally across said body member from one longitudinal side to the other to facilitate the perforating of said strip of tape by said tape perforating means.

4. An apparatus as set forth in claim 3 wherein said body member and said guide means include complementary engaging means for positioning said guide means so that it is precisely centered over said abutting edges of said trailing and leading edge portions and over said perforating groove in said body member.

5. An apparatus as set forth in claim 4 wherein said guide means comprises a plurality of elongate sheet pressing members adapted to overlie said trailing and leading edge portions to maintain said trailing and leading edge portions firmly on said body member with said abutting edges thereof aligned with said perforating groove, and means for securing said sheet pressing members together with the inner adjacent edges of said sheet pressing members disposed in spaced parallel relationship with said perforating groove.

6. An apparatus as set forth in claim 1 wherein said tape perforating means comprises a. an elongate grasping handle, b. a rotary perforating blade mounted for rotation on one end of said handle, and c. means mounted on said grasping handle adjacent said perforating blade for engagement with said guide means for guiding said perforating blade along said abutting edges of said trailing and leading edge portions, whereby said tape is perforated along said abutting edges when said perforating device is moved along said guide means.

7. An apparatus as set forth in claim 6 wherein said grasping handle comprises a. a body member and a complementary cover member, b. means mounting said perforating blade on said cover member, c. abutment means formed on the end of said housing adjacent said perforating blade for normally projecting beyond the peripheral cutting edge of said perforating blade, and d. means mounting said cover member on said housing for limited reciprocatory movement relative thereto between a first position in which said abutment means extends beyond said peripheral edge of said perforating blade and a second position in which said peripheral cutting edge of said perforating blade extends beyond said abutment means.

8. An apparatus as set forth in claim 7 wherein said means mounting said cover member on said housing includes means operatively associated with said cover member and said housing for normally biasing said cover member to said first position so that said peripheral cutting edge of said perforating blade is normally protected by said abutment means.

9. An apparatus as set forth in claim 1 wherein a. said body member includes means defining a perforating groove extending laterally across said body member from one longitudinal side to the other to facilitate the perforating of said strip of tape by said tape perforating means, b. said body member and said guide means include complementary engaging means for positioning said guide means so that it is precisely centered over said abutting edges of said trailing and leading edge portions and over said perforating groove in said body member, c. said guide means comprises a plurality of elongate sheet pressing members adapted to overlie said trailing and leading edge portions to maintain said trailing and leading edge portions firmly on said body member with said abutting edges thereof aligned with said perforating groove, and means for securing said sheet pressing members together with the inner adjacent edges of said sheet pressing members disposed in spaced parallel relationship with said perforating groove, and d. said tape perforating means comprises an elongate grasping handle, a rotary perforating blade mounted for rotation on one end of said handle, and means mounted on said handle adjacent said perforating blade for engagement with said guide means for guiding said perforating blade along said abutting edges of said trailing and leading edge portions and said perforating groove.

10. An apparatus as set forth in claim 9 wherein said means mounted on said handle adjacent said perforating blade for engagement with said guide means comprises a pair of wheels rotatably mounted on said grasping handle on opposite side of said perforating blade in spaced apart relationship such that the outer edges of said wheels engage said inner adjacent edges of said sheet pressing members to ensure that said perforating blade is precisely aligned with said perforating groove in said body member.

11. An apparatus as set forth in claim 10 wherein said body member includes means defining a pair of relatively short perforating grooves disposed adjacent the longitudinal edges of said body member in alignment with longitudinally extending perforation lines separating the sheets of the web from longitudinal feed pin hole strips along the longitudinal edges of the web, said short perforating grooves intersecting said laterally extending perforating groove, and said sheet pressing members include recesses aligned with said short perforating grooves adapted to receive said perforating blade therein to perforate said tape along said longitudinally extending perforation lines to maintain the continuity of said longitudinally extending perforation lines across said trailing and leading edge portions after said tape has been applied to said abutting edges.

* * * * *